United States Patent [19]

Rockx

[11] Patent Number: 5,063,835

[45] Date of Patent: Nov. 12, 1991

[54] PROCESSING BOOTH WITH VARIABLE VENTILATION

[75] Inventor: Ludwig G. Rockx, Boekel, Netherlands

[73] Assignee: Plaatwerkerij D.W. Slotboom B.V., Akkatwijk, Netherlands

[21] Appl. No.: 538,881

[22] Filed: Jun. 15, 1990

[51] Int. Cl.[5] ..... B05B 15/12; B05C 15/00

[52] U.S. Cl. ..... 98/115.2; 55/DIG. 46; 118/326

[58] Field of Search ..... 98/115.2, 115.1; 55/DIG. 46; 118/326

[56] References Cited

U.S. PATENT DOCUMENTS

| | | | |
|---|---|---|---|
| 1,750,774 | 3/1930 | Fahlstrom | 98/115.2 |
| 2,761,373 | 9/1956 | Owen | 98/115.2 |
| 3,168,030 | 2/1965 | Wilhelmsson et al. | 55/DIG. 46 |
| 3,252,401 | 5/1966 | Smith | 55/DIG. 46 |
| 4,879,970 | 11/1989 | Barkalow et al. | 118/326 |
| 4,926,746 | 5/1990 | Smith | 118/326 |

FOREIGN PATENT DOCUMENTS

| | | | |
|---|---|---|---|
| 0978942 | 12/1982 | U.S.S.R. | 118/326 |

*Primary Examiner*—Albert J. Makay
*Assistant Examiner*—William C. Doerrler
*Attorney, Agent, or Firm*—Hoffmann & Baron

[57] ABSTRACT

The invention relates to a cabin for carrying out treatments in it, comprising four walls which are arranged in pairs in spaced substantially parallel relation, the two pairs of walls being mutually substantially perpendicular and at least one or a part of one of the walls being constructed as a door for access to the cabin, and a roof connecting at its lower side as a ceiling onto the four walls and in which the roof comprises means for displacing streams of air in a substantially vertical direction from the ceiling through the cabin and at the bottom of the cabin means are provided for discharging air supplied from the ceiling, the roof comprising a more or less box-shaped construction, at least a part of a large area at the bottom of this construction forming the ceiling and said means comprising fans, valves, filters and air ducts mounted in the box-shaped construction of the roof, while a large portion of the ceiling is in the shape of a grid through which an air stream can be passed in a substantially downward direction.

12 Claims, 4 Drawing Sheets

PROCESSING BOOTH WITH VARIABLE VENTILATION

TECHNICAL FIELD

The invention relates to a cabin for carrying out treatments in it, comprising four walls which are arranged in pairs in spaced substantially parallel relation, the two pairs of walls being mutually substantially perpendicular and at least one or a part of one of the walls being constructed as a door for access to the cabin, and a roof connecting at its lower side as a ceiling onto the four walls.

BACKGROUND OF THE INVENTION

The cabins known at present for carrying out treatments are used for instance for spray painting products or for carrying out other treatments on products in cases where such treatments are to be carried out in a manner as free of dust as possible, but also in cases where during those treatments dust and/or other substances are released, such as vapours or gases which may be harmful to one's health, which are preferably prevented from spreading in the spaces around the cabin. Such a cabin is used for instance as a spraying cabin in body painting shops.

For treatments to be carried out in the cabin in the desired manner, the cabin often comprises means for sucking from the cabin substances that may have formed during the treatments and are to be prevented from spreading. Means may be provided for purifying the air that is sucked from the cabin and contains the substances to be removed and for returning the purified air back into the cabin again. A drawback of the known cabins is that the apparatus required for sucking out air and optionally purifying it and feeding it back into the cabin, takes up a relatively large portion of the working space available. Furthermore, the way in which the air flow in the cabin is controlled is not always optimal in the known cabins.

There is a need, therefore, for a cabin in which the space available for treating products is as large as possible and in which that space is covered as fully as possible by the apparatus for sucking out air and supplying air which may or may not be fresh.

SUMMARY OF THE INVENTION

The need outlined above is satisfied in accordance with the invention by the provision of a cabin in which the roof comprises means for displacing streams of air in a substantially vertical direction from the ceiling through the cabin and at the bottom of the cabin means are provided for discharging air supplied from the ceiling, the roof comprising a more or less box-shaped construction, at least a part of a large area at the bottom of this construction forming the ceiling and said means comprising fans, valves, filters and air ducts mounted in the box-shaped construction of the roof, while a large portion of the ceiling is in the shape of a grid through which an air stream can be passed in a substantially downward direction.

DETAILED DESCRIPTION

The invention is explained and further illustrated with reference to the drawings showing a preferred embodiment of the cabin according to the invention. The description, however, should not be interpreted as limiting the invention in any way. A skilled person using the description to follow hereinafter will be able to readily conceive and design variants of the embodiments to be described hereinafter, which variants are considered to fall within the scope of the invention.

Figure 1:
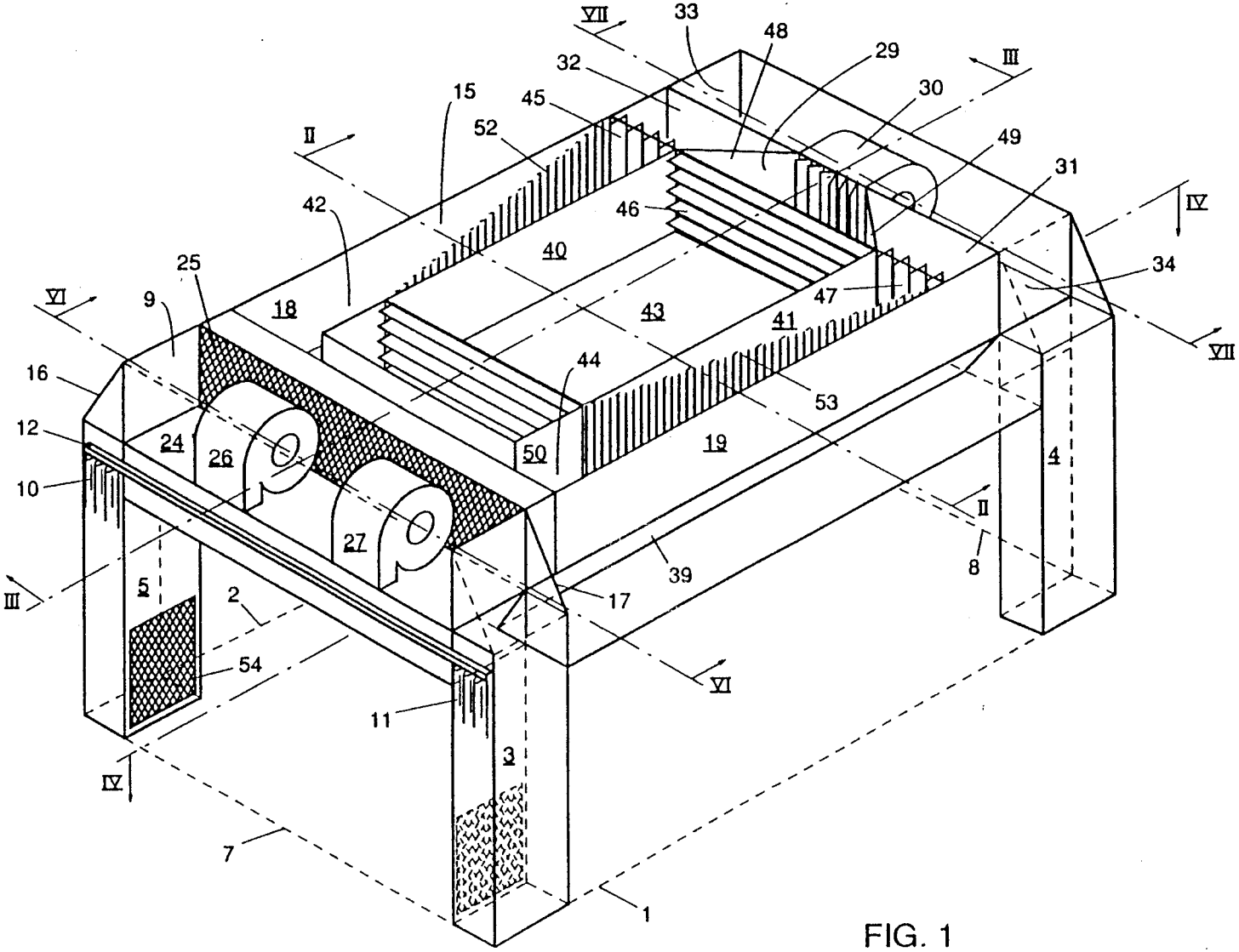
FIG. 1 is a perspective view of a preferred embodiment of the cabin according to the invention.

FIG. 1 shows a preferred embodiment of the cabin according to the invention. It is a perspective view. The cabin comprises two long side walls 1 and 2 extending in spaced parallel relation. As will also appear from the horizontal section according to FIG. 4, the long wall 1 comprises on opposite sides a vertical tube or duct 3, 4, which tubes 3, 4, are of elongate section. Similarly, the long wall 2 comprises on opposite sides the vertical tubes or ducts 5, 6, which are also substantially elongate in cross-section. The vertical tubes 3, 4, 5, and 6, made from plate steel, for instance, support the box-shaped roof construction of the cabin, to be further described hereinafter. The walls 1 and 2 between tubes 3 and 4 and tubes 5 and 6, respectively, are made of suitable material, for instance sheet metal or plastics plates or even synthetic foil. In the walls 1 and 2 between the tubes 3 and 4, and 5 and 6, respectively, windows may optionally be provided to allow light from outside to enter the cabin. It is also possible for entrances to the cabin to be provided in those walls. The exact construction of the walls 1 and 2 is not essential to the invention. It is only important that when the cabin is in operation they form a closure between the interior of the cabin and the space outside.

Figure 4:
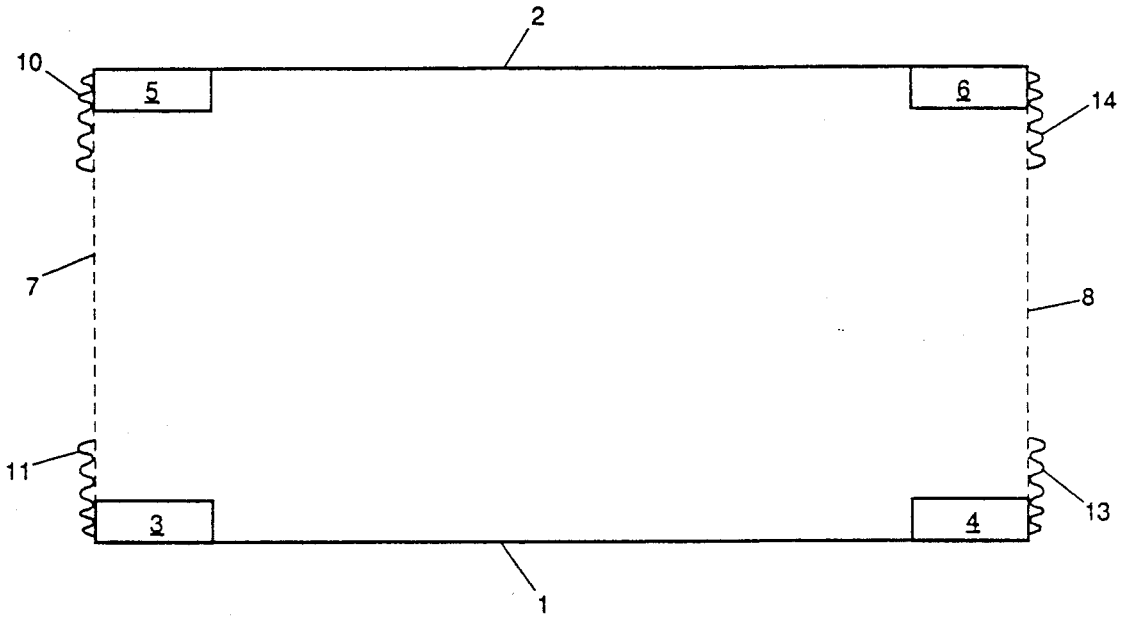
FIG. 4 is a sectional view in a horizontal plane about halfway up the cabin of FIG. 1, taken on the line IV—IV.

The cabin of FIG. 1 further comprises a front wall 7 and a rear wall 8 extending in spaced parallel relation. The short walls 7 and 8 are substantially perpendicular to the long side walls 1 and 2 and together with those walls they define the dimensions of the cabin. As shown in FIG. 4, the extreme short sides of the tubes 3 and 5 are part of the front wall 7 and the extreme short sides of the tubes 4 and 6 form a part of the rear wall 8. As is also clear from the front view of the cabin in FIG. 5, the upper part of the front wall 7 is part of the box-shaped roof construction to be further described hereinafter. Similarly, the upper part of the rear wall 8 is part of the roof construction 9. The opening in the front wall 7 which is bounded by the tubes 3 and 5 and by the lower edge of the box-shaped roof construction 9 can be closed by means of the sliding curtains 10 and 11, hanging from and slidable along the rail 12 mounted on the wall 7. The sliding curtains 10 and 11 in the embodiment of the cabin shown are made of a suitable semi-transparent plastics material of heavy quality. The sliding curtains 10 and 11 can be operated manually. Naturally it is also possible to operate them mechanically by means of suitable electromotors, for instance. Instead of sliding curtains, the front wall may also be closed by means of a similar sheet material as used for the long side walls 1 and 2, an entrance and/or a window being optionally provided in the wall. However, it is preferable to use curtains for reasons to be specified hereinafter. Like the opening in the front wall 7, the opening in the rear wall 8, which is bounded by the sides of the tubes 4 and 6 and by the lower edge of the box-shaped roof construction 9, can be closed by sliding curtains 13 and 14. Here, too, instead of sliding curtains, a more solid closure of sheet material may be provided, which may or may not be provided with doors and/or windows.

Figure 2:
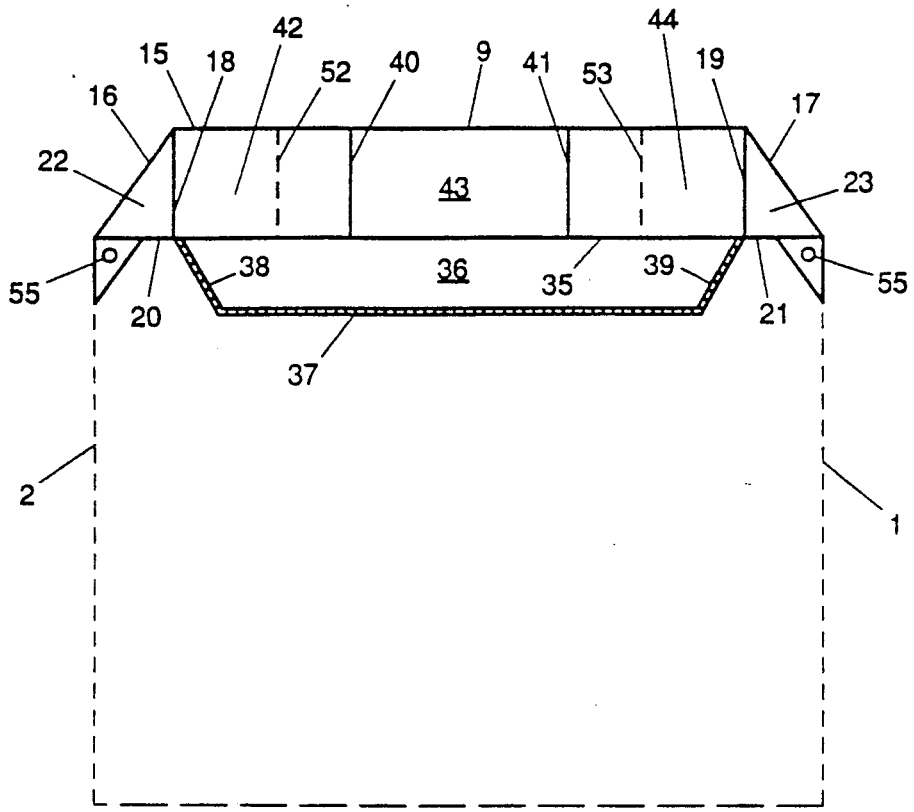
FIG. 2 is a cross-sectional view of the cabin of FIG. 1, taken on the line II—II.
Figure 3:
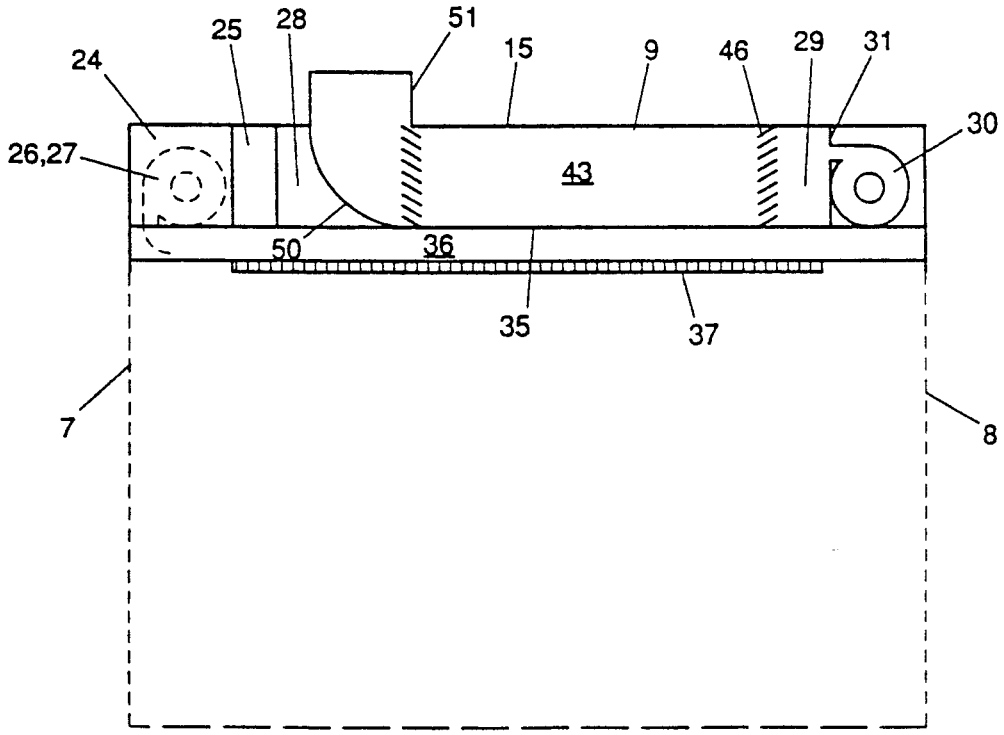
FIG. 3 is a sectional view in longitudinal direction of the cabin of FIG. 1, taken on the line III—III.

The tubes 3, 4, 5 and 6 support the box-shaped roof construction 9. The box-shaped roof construction 9 has a box-shaped structure, which is subdivided into a plurality of compartments and chambers, as will be described hereinafter. The box-shaped roof construction 9 has a top surface 15 whose width equals the distance between the tubes 3 and 5, and 4 and 6, resp. The bottom side of the box-shaped roof construction 9 has a width equalling the distance between the outer walls of the tubes 3 and 5, and 4 and 6, resp. Accordingly, the side surfaces 16 and 17 of the box-shaped roof construction 9 extend upwardly at an angle and form oblique side walls of the box-shaped roof construction 9. Two vertical partitions 18 and 19 extend throughout the length of the box-shaped roof construction 9, each abutting one of the oblique side walls 16 and 17 at the line where that oblique wall intersects the top surface 15. Between the tubes 3 and 4 the space of triangular section, which is bounded by the oblique wall 17 and the vertical partition 19, is bounded by plate 21, so that, as it were, a tube or duct 23 extends between the tubes 3 and 4. In a similar way, between the tubes 5 and 6 a duct 22 is formed, which is defined by the oblique wall 16, the vertical partition 18 and the bottom plate 20, as shown in FIG. 2, for example.

The space of the box-shaped roof construction 9 between the triangular ducts 22 and 23 is subdivided into a plurality of compartments. On the side of the front wall 7 the first compartment is disposed, extending parallel to the short side of the box-shaped roof construction 9 and having a width approximately equal to the width of the tubes 3 and 5. On the long side of the compartment 24, remote from the front wall 7, a filtering wall 25 extends throughout the length of the compartment between the vertical partition 18 and the vertical partition 19. The filtering wall 25 is made of suitable material for filtering air, for example filtering cloth or the like. Arranged in compartment 24 are two fans 26 and 27. In operation the fans draw in air from an adjacent compartment 28 through the filtering wall 25.

On the side of the rear wall 8 the second compartment 29 is disposed, extending parallel to the short side of the box-shaped roof construction 9 and having a width approximately equal to that of tubes 4 and 6. In the compartment 29 a fan 30 is arranged, and so are two vertical partitions 31 and 32, which are arranged adjacently on opposite sides of the outlet end of the fan, so that together with the fan 30 they divide the compartment 29 into two parts throughout its length. The fan 30, arranged in the (rear) part of the compartment 29 which is proximal to the rear wall 8 draws in air into that rear part and blows the air into the adjacent (front) part of the compartment 29 which is remote from the rear wall 8. In the vertical partitions 18 and 19 bounding the ducts or tubes 22 and 23, respectively, openings 33 and 34, respectively, are provided, so that the ducts 22 and 23 communicate with the rear part of the compartment 29. Thus, in operation the fan 30 draws in air supplied to the rear part of the compartment 29 through the tubes 3, 4, 5, and 6 and through the ducts or tubes 22 and 23.

The part of the box-shaped roof construction 9 between the first compartment 24 and the second compartment 29 is divided into two spaces extending substantially horizontally. The lower space 36 is bounded at the bottom by the ceiling 37 of the cabin, which ceiling 37 as to the greater part of its area is shaped as a grid plate, so that air supplied to the space 36 can enter the working space of the cabin through that grid plate. The plate 35 or an extension of it extends into the first compartment 24, where the fans 26 and 27 are arranged on that plate or its extension, having their tuyères terminating under that plate 35 or its extension, so that air drawn in by fans 26 and 27 is blown into the space 36 under the plate 35 to enter the working space of the cabin through the grid section of the ceiling 37.

The grid-shaped ceiling 37 extending between the undersides of the compartments 24 and 29 does not extend sideways as far as the side walls 1 and 2 of the cabin, but extends up to some distance from the walls 1 and 2, whence the grid plate 37 continues into two side surfaces 38 and 39 extending on opposite sides obliquely upwards up to the horizontal plate 35 and abutting that plate at the line of intersection of the plate 35 and the vertical partitions 18 and 19, respectively. This ensures that in operation air supplied to the cabin through the ceiling is passed downwards throughout the sectional area of the cabin as uniformly as possible and prevents upwardly directed streams from arising along the walls of the cabin, which could cause dust, for example, to be carried along, which dust might end up in the downwardly directed stream under the more central part of the ceiling and settle on the products to be treated.

Two vertical partitions 40 and 41 divide the space above the plate 35 between the compartments 28 and 29 into three subcompartments 42, 43, and 44, extending in longitudinal direction, which on the side of the compartment 29 each comprise a valve system 45, 46, and 47, respectively, permitting closure of that subcompartment of the compartment 29. The control of the valves 45, 46, and 47 may be arranged in any suitable manner. A skilled person knows how such valve systems can be controlled, either through manual remote control, by means of suitable control rods, or by using servomotors or the like. The way in which the valves are operated is not a part of the invention. In the front part of the compartment 29 furthermore suitable remote-controlled valves 48 and 49 are arranged for blocking the passage from the tuyère of the fan 30 to the valves 45 and 47, respectively, for the subcompartments 42 and 44, respectively. By means of all these valves, if so desired, all of the air drawn in by the fan 30 can be blown into the subcompartment 43 (valves 45, 47, 48 and 49 shut, valve 46 open), or all of the air taken in can be blown into subcompartments 42 and 44 (valves 45, 47, 48 and 49 open, valve 46 shut), but there are also intermediate options, where the various valves are not completely shut or open.

At the end remote from the compartment 29, the subcompartment 43 connects to a bend 50 connecting the subcompartment 43 with an outlet or discharge duct 51 extending through the top surface 15 of the box-shaped roof construction. When harmful gases are to be discharged from the cabin, the air containing these substances is taken in via the tubes 3, 4, 5, and 6 and the ducts 22 and 23, with the aid of the fan 30, and the valves 45–49 are opened and shut in such a way that all the air is blown into the subcompartment 43, whence the air can be discharged via the duct 51, to be purified, for instance.

In the subcompartments 42 and 44 filtering walls 52 and 53, respectively, are arranged vertically and diagonally, so that the air passing from the compartment 29 to the compartment 28 is forced to pass through those filtering walls. Thus, the air is subjected to a purification step upon passing through the subcompartments in question. In the top surface 15 of the box-shaped roof construction 9, in the front part of the compartment 29 at the location of the subcompartments 42 and 44 passages are provided which are in communication with the exterior and can be closed by means of remote-controlled valves, for supplying air from outside to the subcompartments 42 and 44, if so desired. To avoid obscurity, these passages and valves are not shown in the drawings. When in operation the valves 45–49 are so adjusted that all air from the cabin is discharged via the subcompartment 43, the passages in the top surface 15 may be opened, so that fresh air from outside the cabin is supplied through them and is drawn in by the fans 26 and 27 via the subcompartments 42 and 44 and the compartment 28 and is blown into the cabin via the grid ceiling 37, 38, and 39. Naturally, it is also possible to open the valves partly so as to admix a supply of fresh air.

Air is drawn from the cabin via the tubes 3, 4, 5, and 6, by means of fan 30, to which end, as already explained, the tubes communicate directly (tubes 4 and 6) or via the ducts 22 and 23 (tubes 3 and 5) with the compartment 29. To that end at the bottom end of the tubes 3–6, openings 54 are provided, directed towards the interior of the cabin, in or behind which openings 54 suitable filtering material may be provided for a first purification treatment of the air to be drawn in. Thus in operation air is drawn in at the bottom of the cabin via the openings 54 in the tubes in the long walls of the cabin and air is supplied to the cabin via the ceiling. Thus a highly uniformly distributed vertical airsteam is provided, so that a screen of clean air lies over the ceiling and the walls. Even when a great deal of dust is produced during operations in the cabin, the cabin itself remains clean. During painting, preceded by operations involving the production of dust, there is no risk of dust settling in the paint. All apparatus for providing the uniform air flow is built into the roof construction of the cabin, so that the shop floor can be used optimally. The cabin itself in the embodiment described can be disposed on any more or less flat supporting surface and can be moved as desired. Naturally, an embodiment is conceivable in which a fixed support surface is part of the cabin. In that case sucking air from the cabin could also be effected via grids suitably arranged in the floor and communicating with the discharge fan in the roof construction via tubes or channels similar to tubes 3–6 in the long walls.

In the embodiment of the cabin according to the invention described above the lighting is preferably arranged at the top along the walls 1 and 2, in the corner between these walls and the underside of the ducts 22 and 23 left clear by the ceiling grid 37, 38, 39. By way of example, FIG. 2 shows light fittings 55. An advantage of such an arrangement of the lighting is that it remains free of dust like the walls of the cabin, and the heat produced by the lighting is dissipated during operation by the air flow through the ducts 22 and 23.

The drawings do not show the optional servomotors or other control means for the valve systems mounted in the roof construction. Nor do they show all electric and mechanical links necessary for controlling all parts. A skilled person will have no problems finding a suitable place for such means and links. Further, the drawings do not show the heating piping that may be provided in the cabin. It will be clear that, if so desired, there may be provisions for (pre)heating the air that may be taken in from outside by the fans or even the air re-circulated in the cabin, for instance when a high temperature in the cabin is desirable to accelerate the drying process during a painting treatment in the cabin.

Figure 5:
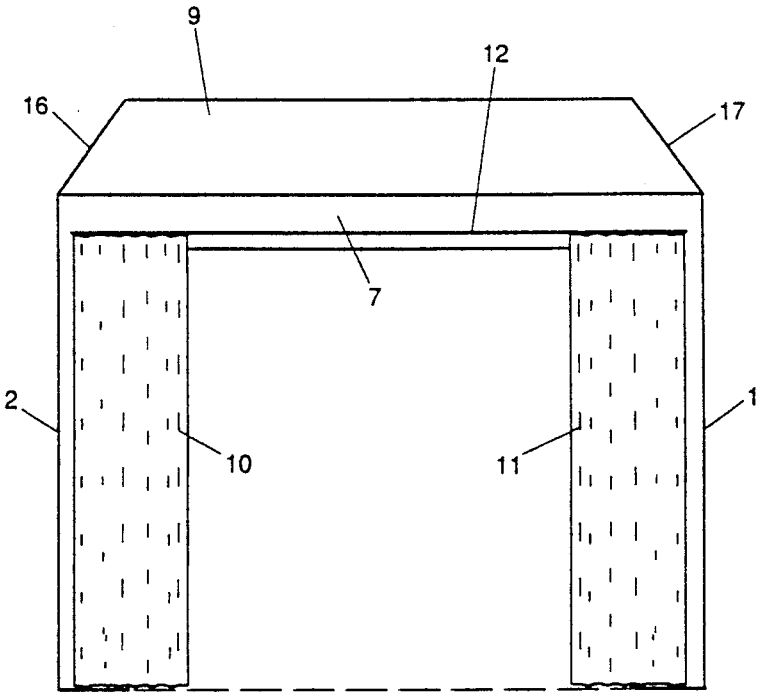
FIG. 5 is a front view of the cabin of FIG. 1.
Figure 6:
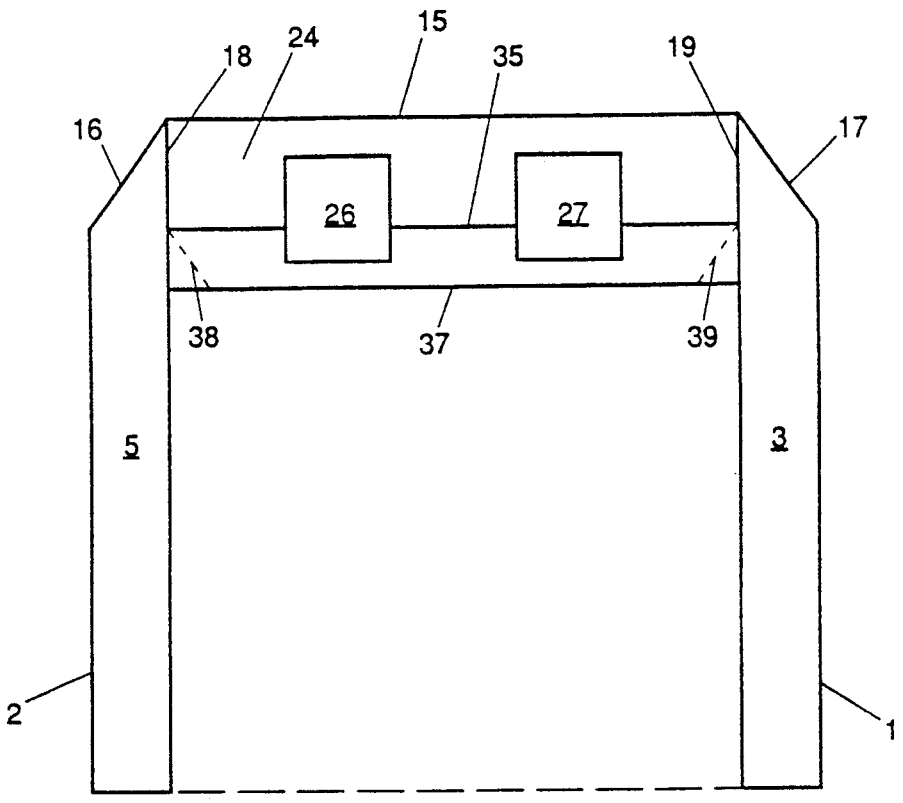
FIG. 6 is a cross-sectional view of the cabin of FIG. 1, taken on the line VI—VI.
Figure 7:
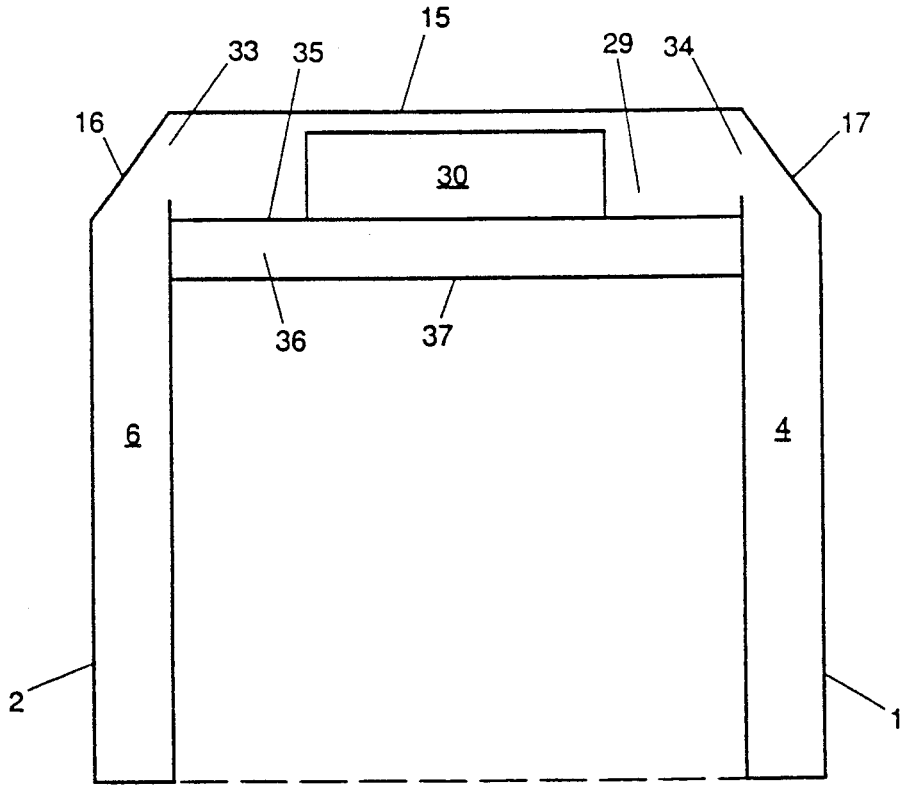
FIG. 7 is a cross-sectional view of the cabin of FIG. 1, taken on the line VII—VII.

As noted with particular reference to FIGS. 4 and 5, the preferred embodiment of the cabin according to the invention comprises sliding curtains. Providing them has the following advantage. When the valves regulating the (partial) closure of the subcompartments are not properly set, the fan 30 will suck out more air than is supplied by the fans 26 and 27, so that a reduced pressure is created in the cabin, or more air will be supplied than can be sucked out, which creates an excess pressure. These phenomena can be directly observed when sliding curtains are used, since the curtains will bulge out into the cabin at a reduced pressure and bulge out in the opposite direction at an excess pressure. When the valve control mechanisms are arranged in the cabin, the operator can adjust the valves into the proper position depending on whether the curtains hang properly. The fans to be used in the cabin according to the invention are of a commercial, conventional type, for instance slowly rotating centrifugal fans having an air output of 20,000 m3, for instance, in the case of a cabin with an interior of typical dimensions (length approx. 5 m, width approx. 4 m, and height approx. 3 m). It will be clear that in the foregoing only one embodiment of the cabin according to the invention was described and that many other variants are conceivable without departure from the invention.

I claim:

1. A treatment booth with variable ventilation comprising:

walls which are arranged into pairs, the walls being spaced in substantially parallel relation, the pairs of walls being mutually substantially perpendicular, at least a part of one of the walls being constructed as a door for access to and from the treatment both, the treatment booth having a chamber defined by an interior portion of the walls, at least a first pair of walls being short, at least a second pair of walls being long;

a roof portion having an upper side and a lower side, the lower side of the roof adjoined to the walls, the lower side the roof functioning as a ceiling for the chamber, a large portion of the lower side of the roof having a grid which allows air to pass therethrough, the roof portion having a means for displacing air through the grid in a substantially vertical downward direction, the roof portion having an elongated box shape, the roof portion divided into at least a first compartment and a second compartment in communication with each other, the first compartment and the second compartment extending parallel to the first pair of walls, the roof portion having a roofing chamber between the first and second compartment, the first compartment having at least one fan being disposed inside, the second compartment having at least one fan disposed inside, the roofing chamber being divided by partitions to form a first substantially horizontal bottom compartment bounded by the lower side of the roof portion and a second substantially horizontal top compartment bounded by the upper side of the roof portion, the first and second substantially horizontal compartments being divided by vertical partitions into a plurality of mutually parallel subcompartments, the plurality of mutually parallel subcompartments each having a boundary parallel to the second pair of the walls.

2. A treatment booth with variable ventilation according to claim 1, wherein the first substantially horizontal bottom compartment extends transversely along the treatment booth to a distance from each respective wall of the treatment booth, the first substantially horizontal compartment having an upper boundary defined by a horizontal plate and a lower boundary defined by the lower side of the roof portion, the first substantially horizontal compartment having lateral boundaries defined by sidewalls obliquely extending from the lower boundary to the upper boundary, the sidewalls forming an extension of the lower side of the roof portion, the first substantially horizontal compartment having at least one fan.

3. A treatment booth with variable ventilation according to claim 1, wherein the first compartment communicates with the first substantially horizontal bottom compartment and with at least one of the plurality of mutually parallel subcompartments so that air supplied through at least one of the plurality of mutually parallel subcompartments can be blown into the first substantially horizontal bottom compartment by at least one fan.

4. A treatment booth with variable ventilation according to claim 1, wherein the second compartment communicates with at least one of the plurality of mutually parallel subcompartments, the second compartment having at least one fan, a passageway coupling the second compartment with each of the subcompartments, each passageway between the second compartment and each of the subcompartments having a valve, the valve allowing air from the second compartment to be provided to one or more of the subcompartments.

5. A treatment booth with variable ventilation according to claim 4, wherein the treatment booth further comprises at least one filter wall disposed in at least one of the plurality of mutually parallel subcompartments, the plurality of mutually parallel subcompartments communicating with both the first and second compartments that extend parallel to the first pair of walls, at least one filter wall being arranged so that air passing through the plurality of mutually parallel subcompartments must pass through the filter wall.

6. A treatment booth with variable ventilation according to claim 5, wherein the filter wall is arranged in a substantially vertical position, the filter wall extending diagonally across a respective mutually parallel subcompartment.

7. A treatment booth with variable ventilation as defined by claim 4, wherein at least on of the plurality of mutually parallel subcompartments coupled to the second compartment does not communicate with the first compartment, and wherein a discharge duct communicates with a region outside the roof portion of the treatment booth.

8. A treatment booth with variable ventilation as defined by claim 4, wherein the treatment booth further comprises a closable duct within at least one of the plurality of mutually parallel subcompartments, the closable duct operatively coupling one of the plurality of mutually parallel subcompartments with the first and second compartments.

9. A treatment booth with variable ventilation as defined by claim 4, wherein the treatment booth further comprises a closable duct within the second compartment in the vicinity of at least one of the plurality of mutually parallel subcompartments, the closable duct coupling the second compartment with a region outside the roof portion of the treatment booth, the closable duct allowing air from outside the roof portion of the treatment booth to be taken in the through the closable duct by at least one fan in the first compartment.

10. A treatment booth with variable ventilation as defined by claim 1, wherein the roof portion contains two substantially horizontal ducts extending on opposite sides of the treatment booth, each substantially horizontal duct having a length dimension, each substantially horizontal duct having a width dimension and a height dimension, the length dimension of the two substantially horizontal ducts being substantially parallel to the second pair of the walls, each substantially horizontal duct being connected to a plurality of vertical ducts, the plurality of vertical ducts being build into or secured to the second pair of walls of the cabin, the plurality of vertical ducts having venting openings communication an interior portion of each vertical duct communicating with the chamber of the treatment booth, each substantially vertical duct terminating in one of the first and the second compartments of the roof portion so that air from the chamber of the treatment booth can be provided to one of the first and the second compartments by at least one fan in one of the first or the second compartments.

11. A treatment booth with variable ventilation as defined by claim 10, wherein the treatment booth further comprises a plurality of filters disposed in the venting openings, the plurality of filters performing a first purifying process upon air that is provided to the plurality of vertical ducts.

12. The treatment booth with variable ventilation as defined by claim 10 wherein the walls of the cabin are self supporting so that the treatment booth is portable and is capable of being disposed on any substantially flat surface.

* * * * *